US009568926B2

(12) United States Patent
Su et al.

(10) Patent No.: US 9,568,926 B2
(45) Date of Patent: Feb. 14, 2017

(54) POWER SUPPLY INTERFACE HAVING MULTIPLE VOLTAGE SOURCES

(71) Applicant: NXP B.V., Eindhoven (NL)

(72) Inventors: Chiahung Su, Tempe, AZ (US); Madan Vemula, Tempe, AZ (US); Siamak Delshadpour, Phoenix, AZ (US)

(73) Assignee: NXP B.V., Eindhoven (NL)

( * ) Notice: Subject to any disclaimer, the term of this patent is extended or adjusted under 35 U.S.C. 154(b) by 60 days.

(21) Appl. No.: 14/499,999

(22) Filed: Sep. 29, 2014

(65) Prior Publication Data

US 2016/0091907 A1 Mar. 31, 2016

(51) Int. Cl.
*G05F 1/575* (2006.01)
*G05F 1/56* (2006.01)
*G05F 1/46* (2006.01)

(52) U.S. Cl.
CPC .. *G05F 1/56* (2013.01); *G05F 1/46* (2013.01)

(58) Field of Classification Search
CPC ..... G05F 1/56; G05F 1/565; G05F 1/575; H02M 3/156–3/158; H02M 3/1584; H02M 3/1588
USPC ..... 323/265, 273, 274, 280–285; 363/59
See application file for complete search history.

(56) References Cited

U.S. PATENT DOCUMENTS 5,227,666 A 7/1993 Asprey
5,387,820 A 2/1995 Imagawa
5,828,293 A * 10/1998 Rickard ..... H04B 3/542 340/12.32
8,026,636 B2 * 9/2011 Oh ..... G05F 1/46 307/31
8,169,203 B1 5/2012 Vemula
2005/0213356 A1 * 9/2005 Yanagida ..... H02M 3/07 363/59

(Continued)

FOREIGN PATENT DOCUMENTS

CN 1 069366 A 2/1993
JP 58-182725 A 10/1983
WO WO-2013/029029 A8 4/2013

OTHER PUBLICATIONS

Su, C., et al., "A high-temperature, high-voltage, fast response linear voltage regulator". Analog Integrated Circuits and Signal Processing, Aug. 2012, vol. 72, Issue 2, pp. 405-417.

(Continued)

*Primary Examiner* — Yemane Mehari

(57) ABSTRACT

Aspects of the present disclosure are directed to circuits, apparatuses, and methods for power management. According to an example embodiment, an apparatus includes a low drop-out (LDO) voltage-regulation circuit configured to generate a regulated voltage from a voltage provided to a supply terminal of the LDO voltage-regulation circuit. The apparatus also includes switching circuitry coupled to the LDO voltage-regulation circuit and to a plurality of voltage sources. The voltage sources include at least power line carried along with a data bus and another voltage source. Each of the plurality of voltage sources provides a respectively different voltage range. The switching circuitry is configured, in response to a power-related condition of the plurality of voltage sources and while maintaining power to the LDO voltage-regulation circuit, to select and couple one of the voltage sources to the supply terminal and uncouple other ones of voltage sources from the supply terminal.

23 Claims, 5 Drawing Sheets

(56) References Cited

U.S. PATENT DOCUMENTS

| | | | | |
|---|---|---|---|---|
| 2010/0219687 | A1* | 9/2010 | Oh | G05F 1/46 307/39 |
| 2012/0274407 | A1 | 11/2012 | Nonis et al. | |
| 2013/0049462 | A1* | 2/2013 | Chen | H05B 33/0842 307/18 |
| 2013/0320942 | A1* | 12/2013 | Vemula | G05F 1/573 323/274 |

OTHER PUBLICATIONS

Extended European Search Report for Patent Appln. No. 15185208.4 (Mar. 8, 2016).

Mok Philip K T: "Single-inductor-multiple-output DC-DC converter design", Proceedings of the IEEE 2013 Custom Integrated Circuits Conference, retrieved on Nov. 7, 2013; pp. 1-70, (Sep. 22, 2013).

Office Action for Application No. CN 201510629085.4, 12 pages (Oct. 9, 2016).

* cited by examiner

POWER SUPPLY INTERFACE HAVING MULTIPLE VOLTAGE SOURCES

Aspects of various embodiments are generally related to electrical systems and methods for operating the electrical systems.

A power supply interface circuit can provide electrical energy to one or more electronic components. A power supply interface circuit may include, for example, a an interface and a voltage regulator circuit that receives input supply signals from a power supply and provides regulated output signals within a desired range. Power supply interface circuits may be selectably configured to various power sources that may be available. For instance, a supply interface circuit may be configured to select from available power supplies when first powered on or when power cycled. However, a selected power supply may become unavailable or may exhibit a decrease in voltage and/or current during operation that renders the power supply unable to power the voltage regulator. For instance, a power supply can be become current limited, where the power supply is unable to supply a required amount of current to the power regulator. After the power supply is current limited for an extended period of time, the input voltage to the voltage regulator circuit can drop below a certain voltage threshold or be cut off. The voltage regulator circuit can be shut down when the input supply voltage to the voltage regulator circuit drops below the voltage threshold, a power supply interface may power cycle so a new power supply may be selected.

Various example embodiments are directed to apparatuses, circuits, and methods for power management.

According to an example embodiment, an apparatus includes a low drop-out (LDO) voltage-regulation circuit configured to generate a regulated voltage from a voltage provided to a supply terminal of the LDO voltage-regulation circuit. The apparatus also includes switching circuitry coupled to the LDO voltage-regulation circuit and to a plurality of voltage sources. The voltage sources include at least a power line carried along with a data bus and another voltage source. Each of the plurality of voltage sources provides a respectively different voltage range. The switching circuitry is configured, in response to a power-related condition of the plurality of voltage sources and while maintaining power to the LDO voltage-regulation circuit, to select and couple one of the voltage sources to the supply terminal and uncouple other ones of the voltage sources from the supply terminal.

In another example embodiment, a method is provided for generating a regulated voltage. In response to a power-related condition of the plurality of voltage sources, and while maintaining power to an LDO voltage-regulation circuit, a switching circuit is used to select and couple one of a plurality of voltage sources to a supply terminal of a voltage regulation circuit and uncouple other ones of the voltage sources from the supply terminal. The plurality of voltage sources includes at least a power line carried along with a data bus and another voltage source. Using the LDO voltage-regulation circuit, a regulated voltage is generated from a voltage provided to a supply terminal of the LDO voltage-regulation circuit.

In another example embodiment, an apparatus includes a voltage-regulation means for generating a regulated voltage from a voltage provided to a supply terminal of the voltage-regulation means. The apparatus also includes a switching means for coupling and uncoupling a plurality of voltage sources to and from the supply terminal. In response to a power-related condition of the plurality of voltage sources, and while maintaining power to the voltage-regulation means, the switching means selects and couples one of the voltage sources to the supply terminal and uncouples other ones of the voltage sources from the supply terminal. The plurality of voltage sources includes at least a power line carried along with a data bus and another voltage source.

The above discussion/summary is not intended to describe each embodiment or every implementation of the present disclosure. The figures and detailed description that follow also exemplify various embodiments.

Various example embodiments may be more completely understood in consideration of the following detailed description in connection with the accompanying drawings, in which.

Figure 1:
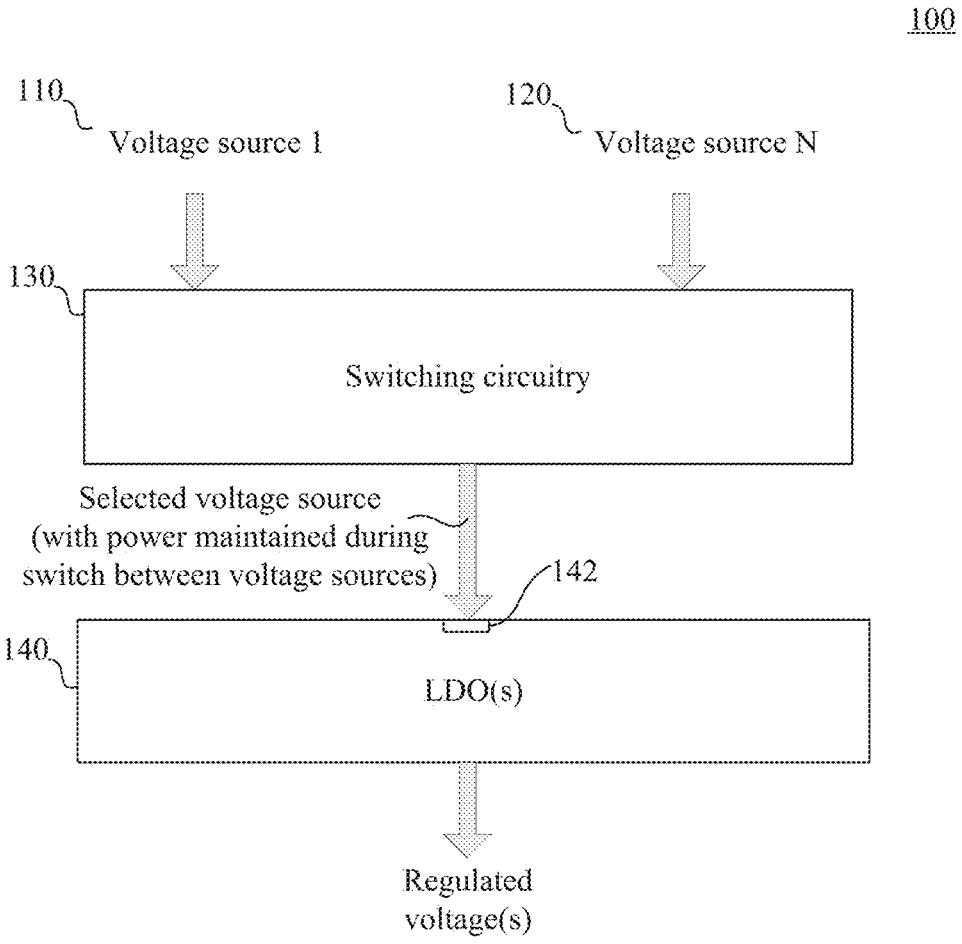
FIG. 1 shows a block diagram of a first system configured to dynamically transition between multiple voltage sources, in accordance with one or more embodiments.

While various embodiments discussed herein are amenable to modifications and alternative forms, aspects thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the disclosure including aspects defined in the claims. In addition, the term "example" as used throughout this application is only by way of illustration, and not limitation.

Aspects of the present disclosure are believed to be applicable to a variety of different applications involving electronic devices having multiple power supplies available. While not necessarily so limited, various aspects may be appreciated through a discussion of examples using this context.

Various example embodiments are directed to circuits, apparatuses, and methods for power management. According to an example embodiment, an apparatus includes an low drop-out (LDO) voltage-regulation circuit configured to generate a regulated voltage from a voltage provided to a supply terminal of the LDO voltage-regulation circuit. The apparatus also includes switching circuitry coupled to the LDO voltage-regulation circuit and to a plurality of voltage sources. The voltage sources include at a least power line carried along with a data bus and another voltage source. Each of the plurality of voltage sources provides a respectively different voltage range. The switching circuitry is configured, in response to a power-related condition of the plurality of voltage sources and while maintaining power to the LDO voltage-regulation circuit, to select and couple one of the voltage sources to the supply terminal and uncouple other ones of voltage sources from the supply terminal. For ease of reference, an LDO voltage-regulation circuit may be referred to as an LDO regulator.

In some embodiments, the apparatus includes an energy storage circuit (e.g., a capacitor) coupled to the supply terminal of the LDO regulator. The energy storage circuit may be configured to store an amount of energy sufficient to power the LDO regulator if the previously selected voltage source is uncoupled from the supply terminal before the newly selected voltage source is coupled to the supply terminal and current flow to the supply terminal is restored.

In some embodiments, the selection circuitry is configured to couple a selected voltage source to supply terminals of multiple LDO regulators. For example, an apparatus may include a first LDO regulator to generate a regulated voltage for critical analog circuits and a second LDO regulator to generate a regulated voltage for digital circuits.

In some embodiments, the apparatus is configured to select from at least three voltage sources. The switching circuitry is further configured to select another one of the plurality of voltage sources, based on the power-related condition in response to the voltage source coupled to the supply terminal becoming unavailable. While maintaining power to the LDO regulator, the switching circuitry couples the newly selected voltage sources to the supply terminal and uncouples other ones of the plurality of voltage sources from the supply terminal.

In various implementations, the switching circuitry may couple voltage sources to the supply terminal directly or indirectly. For instance, the switching circuitry is configured to couple the low-voltage sources directly to the supply terminal of a low-output voltage-regulation circuit when selected, and indirectly couple the high-voltage sources to the supply terminal indirectly via voltage converter. In some examples, the apparatus includes a high-output LDO regulator and a bypass switch, configured to couple an output of the high-output voltage-regulation circuit to the supply terminal of the low-output voltage-regulation circuit when enabled. The high-output LDO regulator steps down the voltage from the high-voltage source before it is provided to the low-output LDO regulator. When a high-voltage source is selected, the switching circuitry couples the high-voltage source to the high-output LDO regulator and enables the bypass switch, thereby coupling the high-voltage source to the low-output LDO regulator. When a low-voltage source is selected the switching circuitry couples the low-voltage source directly to the low-output LDO regulator and disables the bypass switch.

The switching circuitry may include various circuits for determining conditions of, selection of, and coupling of the voltage sources. In some embodiments, the switching circuitry includes a respective switching circuit for each of the voltage sources connected to the switching circuitry. Each switching circuit is configured to couple the voltage source to the supply terminal of a LDO regulator when enabled, and uncouple the voltage source from the supply terminal when disabled. The switching circuitry may also include a control circuit configured to enable and disable the switching circuits based on the conditions of the voltage sources.

The control circuit may dynamically select a voltage source based on and in response to changes in the condition of the voltage sources. For instance, in response to a selected voltage source becoming unavailable, the control circuit selects another one of the voltage sources based on the current operation condition of the voltage sources. In response to selecting a new voltage source, the control circuit transitions from the previously selected voltage source to the newly selected voltage source by disabling the switching circuit for the previously selected voltage source and enabling the switching circuit for the newly selected voltage source. The control circuit is configured to transition to the new voltage while maintaining power to the LDO regulator and without power cycling to select a new voltage source.

The embodiments may be adapted to select and couple various types and numbers of voltage sources that may be available in a particular application. For ease of explanation, the examples may be primarily discussed with reference to a device configured to select from three voltage sources including a platform power supply (e.g., a battery supply), an ACDC power adapter, and a power line carried along with a data bus (e.g., a USB connector power terminal). While not necessarily so limited, various aspects may be appreciated through a discussion of examples using this context.

Turning now to the figures, FIG. 1 shows a block diagram of a first system configured to dynamically transition between multiple voltage sources, in accordance with one or more embodiments. The system 100 includes one or more LDO regulator(s) 140, each configured to generate a regulated voltage from a voltage provided to a supply terminal 142. The system 100 also includes switching circuitry 130 coupled to the LDO regulator(s) 140 and to a plurality of voltage sources 110 and 120. The switching circuitry 130 is configured to select one of the voltage sources 110 and 120 based on various power-related conditions of the voltage sources (e.g., voltage levels, current levels, and/or noise levels). The switching circuitry 130 couples the selected voltage source to the supply terminal 142 and uncouples other ones of voltage sources from the supply terminal 142.

In response to changes in the power-related conditions of the voltage sources (e.g., a selected voltage source becoming unavailable or current limited), the switching circuitry 130 dynamically selects a new voltage source based on the power-related conditions. In response to selecting a new voltage source and while maintaining power to the supply terminal 142, the switching circuitry 130 uncouples the previously selected voltage supply from the supply terminal 142 and couples the newly selected voltage source from the supply terminal 142.

Figure 2:
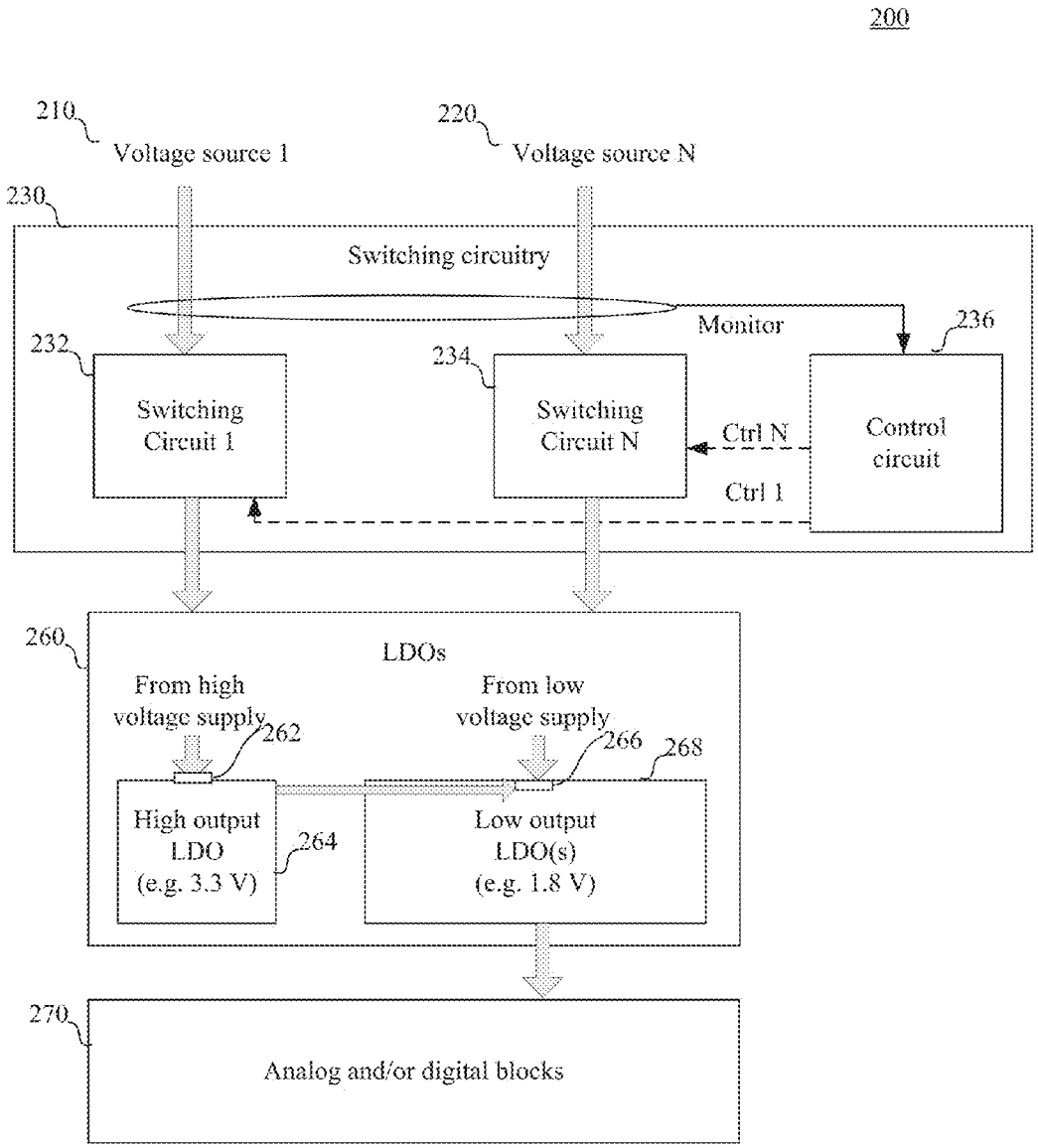
FIG. 2 shows a block diagram of a second system configured to dynamically transition between multiple voltage sources, in accordance with one or more embodiments.

FIG. 2 shows a block diagram of a second system configured to dynamically transition between multiple voltage sources, in accordance with one or more embodiments. The system 200 includes a set of LDO regulators 260, each configured to generate a respective regulated voltage from voltage provided to a supply terminal 262 or 266 of the LDO regulator. In this example, the set of LDO regulators 260 includes one or more low-output LDO regulators 268 configured to generate a regulated voltage from voltage provided to the supply terminal 266, and to provide the regulated voltage to one or more analog and/or digital logic blocks 270 of the system 200. In this example, the set of LDO regulators 260 also includes a high-output LDO regulator 264, configured to generate a regulated voltage from a high-voltage supply provided to its supply terminal 262. As shown in this example, the regulated voltage of the high-output LDO regulator 264 may be provided to the supply terminal 266 to power the low-output LDO(s) 268. Alternatively or additionally, the high-output LDO regulator 264 may provide the regulated voltage to one or more analog and/or digital logic blocks 270.

The system 200 includes switching circuitry 230 coupled to the set of LDO regulators 260 and to a plurality of voltage sources 210 and 220. The switching circuitry 230 is configured to select and couple one of the voltage sources 210 and 220 based on various power-related conditions of the voltage sources (e.g., voltage levels, current levels, and/or noise levels). In this example, the switching circuitry 230 includes respective switching circuits 232 and 234 for each of the voltage sources 210 and 220 connected to the switching circuitry 230. Each switching circuit 232 and 234 is configured to couple the voltage source connected thereto to the supply terminal 266 of the low-output LDO regulators 268 when enabled. Some of the switching circuits 232 and 234 may couple a voltage supply to the supply terminal 266 directly. Some of the switching circuits 232 and 234 may directly couple low-voltage sources to the supply terminal 266. Some other switching circuits 232 and 234 may couple high-voltage sources indirectly to the supply terminal 266 via the high-output LDO regulator 264.

The switching circuitry 230 includes a control circuit 236 configured to monitor power related conditions of the voltage sources 210 and 220 and to generate control signals (Ctrl 1, Ctrl N) to enable and disable the switching circuits, based on the power related conditions. The control circuit 236 may dynamically select a voltage source based on, and in response to, changes in the condition of the voltage sources. For instance, in response to a selected voltage source 210 or 220 becoming unavailable, the control circuit 236 selects another one of the voltage sources based on the current operation condition of the voltage sources 210 and 220. In response to selecting a new voltage source 210 or 220 the control circuit 236 transitions from the previously selected voltage source to the newly selected voltage source by disabling the switching circuit 232 or 234 for the previously selected voltage source and enabling the switching circuit for the newly selected voltage source. The control circuit is configured to transition to the new voltage while maintaining power to the LDO regulator.

Figure 3:
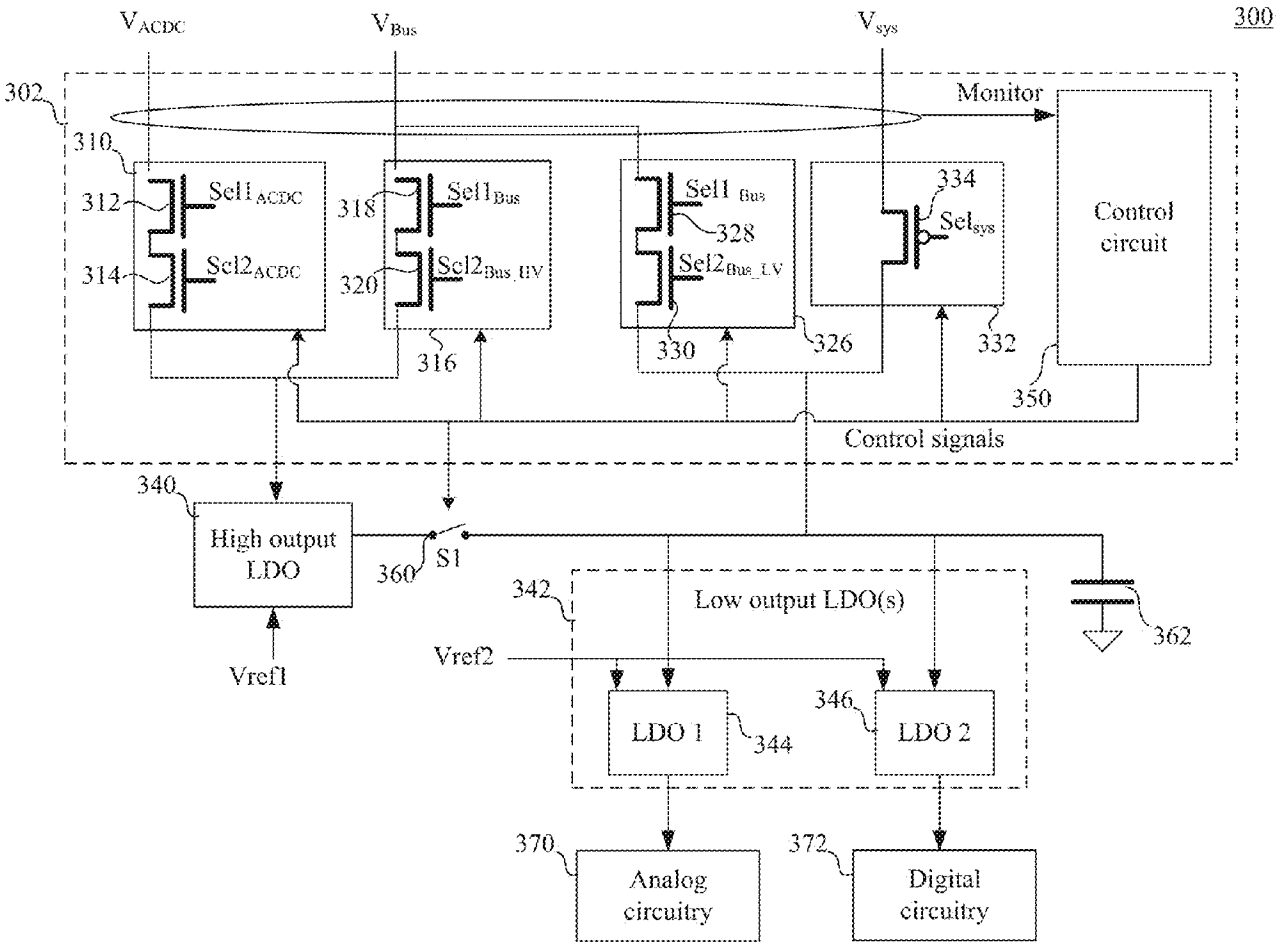
FIG. 3 shows a block diagram of a third system configured to dynamically transition between multiple voltage sources, in accordance with one or more embodiments.

FIG. 3 shows a block diagram of a third system, configured to dynamically transition between multiple voltage sources, in accordance with one or more embodiments. The system 300 includes a set of low-output LDO regulators 342, configured to generate regulated voltages from a voltage provided to the set of low-output LDO regulators 342 by an energy storage circuit 362. In this example, the set of low-output LDO regulators 342 include two LDO regulators 344 and 346. LDO regulator 344 is configured to provide a first regulated voltage to a set of analog circuits 370 and LDO regulator 346 is configured to provide a second regulated voltage to a set of digital circuits 372. In this example, system 300 also includes a high-output LDO regulator 340 configured to generate a regulated voltage from a high-voltage supply. A bypass switch 360 is configured to provide the regulated voltage output the from the high-output LDO regulator 340 to low-output LDO regulators 342 and energy storage circuit 362 when closed. When opened, bypass switch 360 isolates the high-output LDO regulator 340 from the low-output LDO regulators 342 and energy storage circuit 362. In some implementations, the voltage level of the regulated voltages generated by the LDO regulators 340, 344, and 346 is controlled by reference voltages Vref1 and Vref2 provided to the LDO regulators.

The system 300 includes switching circuitry 302 coupled to the LDO regulators 340, 344, and 346 and to a plurality of voltage sources. In this example, the switching circuitry is coupled to three voltage sources including an ACDC power adapter ($V_{ACDC}$), a USB connector power terminal ($V_{BUS}$), a platform power supply battery ($V_{SYS}$). Each of these three supply voltages ($V_{SYS}$, $V_{ACDC}$, and $V_{BUS}$) may have different operational ranges in voltage amplitude. For instance, the $V_{SYS}$ may be specified at 3.3V with ±10 percent variations, $V_{ACDC}$ ranges from 5~28V, and $V_{BUS}$ is between 3~28V. For ease of reference, $V_{ACDC}$, and $V_{BUS}$ may be referred to as high-voltage sources, and $V_{sys}$ may be referred to as a low-voltage source.

The switching circuitry 302 is configured to select and couple one of the voltage sources to the energy storage circuit 362 and the LDO regulators 344 and 346, based on various power-related conditions of the voltage sources. The switching circuitry 302 includes one or more switching circuits 310, 316, 326, and 332 for each of the voltage sources. Each of the switching circuits 310, 316, 326, and 332 are configured to couple one of the voltage sources to the energy storage circuit 362 and low-output LDO regulators 342 when enabled, and to uncouple the voltage source from the energy storage circuit 362 and low-output LDO regulators 342 when disabled.

Control circuit 350 is configured to monitor power related conditions of the voltage sources $V_{SYS}$, $V_{ACDC}$, and $V_{BUS}$, and to generate control signals to enable and disable the switching circuits based on the power related conditions. As described with reference to control circuit 236 in FIG. 2, the control circuit 350 may dynamically select a voltage source based on and in response to power-related conditions of the voltage sources. The control circuit 350 generate control signals to enable the switching circuit 310, 316, 326, and 332 corresponding to the selected voltage supply and the disable switching circuits 310, 316, 326, and 332 for the other voltage supplies. In response to a selected voltage source becoming unavailable, the control circuit 350 dynamically selects another one of the voltage sources, based on the current operation condition of the voltage sources. In response to selecting a new voltage source, the control circuit 350 adjusts the control signals to disable the switching circuit for the previously selected voltage source, and enable the switching circuit for the newly selected voltage source, while maintaining power to the LDO regulator.

Switching circuits 310 and 316 are configured to respectively couple the high-voltage sources $V_{ACDC}$ and $V_{BUS}$ to the high-output LDO regulator 340 when enabled. Switching circuit 332 is configured to couple the $V_{SYS}$ voltage supply directly to the energy storage circuit 362 and low-output LDO regulators 342, when enabled. In some applications, a high-voltage power supply may provide a lower voltage in certain circumstances. For example, if $V_{BUS}$ becomes current limited (e.g., due to a large number of USB devices using the same USB bus for power), the voltage of $V_{BUS}$ will decrease. In this example, a second switching circuit 326 is connected to $V_{BUS}$ and is configured to couple $V_{BUS}$ to directly to the low-output LDO regulators 342 and energy storage circuit 362 when enabled.

In this example, the switching circuits 310, 316, 326, and 332 are implemented using transistors 312, 314, 318, 320, 328, 330, and 334, having gates driven by respective control signals $Sel1_{ACDC}$, $Sel2_{ACDC}$, $Sel1_{Bus}$, $Sel2_{Bus_HV}$, $Sel1_{Bus}$, $Sel2_{Bus_LV}$, and $Sel_{sys}$, provided by the control circuit 350. In this example, the switching circuits 310, 316, 326 connected to high-voltage supplies $V_{ACDC}$ and $V_{BUS}$ each include a high-voltage transistor 312, 318, or 328, connected in series with a low voltage transistor 314, 320, and 330. In some implementations, the control circuit 350 may turn on the high-voltage transistors 312, 318, or 328 whenever the voltage source connected thereto is detected and otherwise turn the high-voltage transistors off. The control circuit may couple and decouple the voltage sources to or from the energy storage circuit by turning low-voltage transistors 314, 320, and 330 on or off.

When a voltage source is selected and coupled by the switching circuitry 302, the energy storage circuit and/or LDO regulators 340 and 342 may draw a larger amount of current, which may cause the voltage to suddenly drop or exhibit instability. In some embodiments, when a voltage source is detected and a high-voltage transistor 312, 318, or 328 is enabled (if applicable) the control circuit 350 may debounce control signals $Sel2_{ACDC}$, $Sel2_{Bus_HV}$, $Sel2_{Bus_LV}$, or $Sel_{sys}$ to transistors 314, 320, 330, and/or 334 to prevent the switching circuits from coupling the supply voltage until the supply voltage has stabilized. Additionally or alternatively, the control circuit 350 may be configured to turn transistors 314, 320, 330, and/or 334 on gradually, to slowly ramp-up current drawn from the voltage supply when the voltage supply is coupled to the LDO regulators 340 and 342 and energy storage circuit 362.

The control circuit may implement various algorithms for selecting the voltage sources, based on detected power-related conditions of the voltage sources. Some example processes for selecting voltage sources are described with reference to FIGS. 4 and 5. Although, example threshold voltage levels for selecting voltage sources are provided in FIGS. 4 and 5, the embodiments are not so limited. Rather, the embodiments may be adapted to select voltage sources using various algorithms and threshold voltages.

Figure 4:
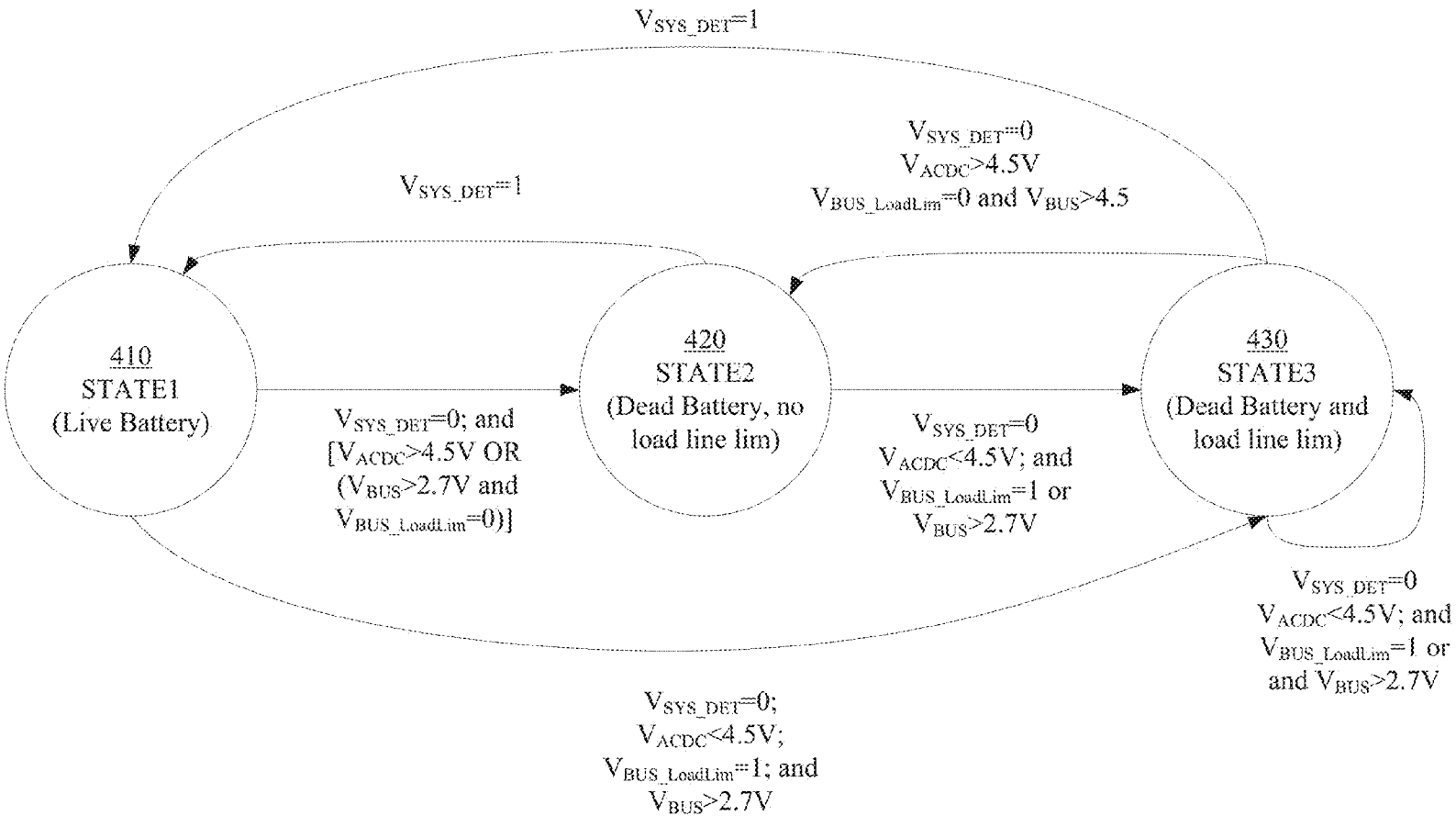
FIG. 4 shows a state machine that may be implemented by a control circuit, in accordance with one or more embodiments.

FIG. 4 shows an example state machine that may be implemented by a control circuit for selection of voltage sources, in accordance with one or more embodiments. In this example, the control circuit transitions to a first state 410 whenever a system battery ($V_{SYS}$) is detected ($V_{SYS_det}$=1). In the first state, the control circuit selects the $V_{SYS}$ voltage source for use. If $V_{SYS}$ becomes unavailable, for example due to a dead battery, the control circuit transitions to a second state 420 or a third state 430 depending on the condition of $V_{ACDC}$ and $V_{BUS}$. In the second state, the control circuit couples one of $V_{ACDC}$ or $V_{BUS}$ to a high-output LDO (e.g., 340). In this example, the control circuit transitions to a second state 420 if $V_{ACDC}$ greater than 4.5V. If $V_{SYS}$ is unavailable and $V_{ACDC}$ is less than 4.5V, the control circuit operates in the second state 420 or the third state 430 depending on the condition of $V_{BUS}$. If $V_{BUS}$ is greater than 2.7V and is not load limited, the control circuit operates in the second state 420 and couples $V_{BUS}$ to the high-output LDO. Otherwise, if $V_{SYS}$ and $V_{ACDC}$ are unavailable, and $V_{BUS}$ drops below 2.7V or becomes voltage limited, the control circuit transitions to the third state 430. In the third state, the control circuit couples $V_{BUS}$ directly to the high-output LDO, for example, using switching circuit 326 in FIG. 3.

Figure 5:
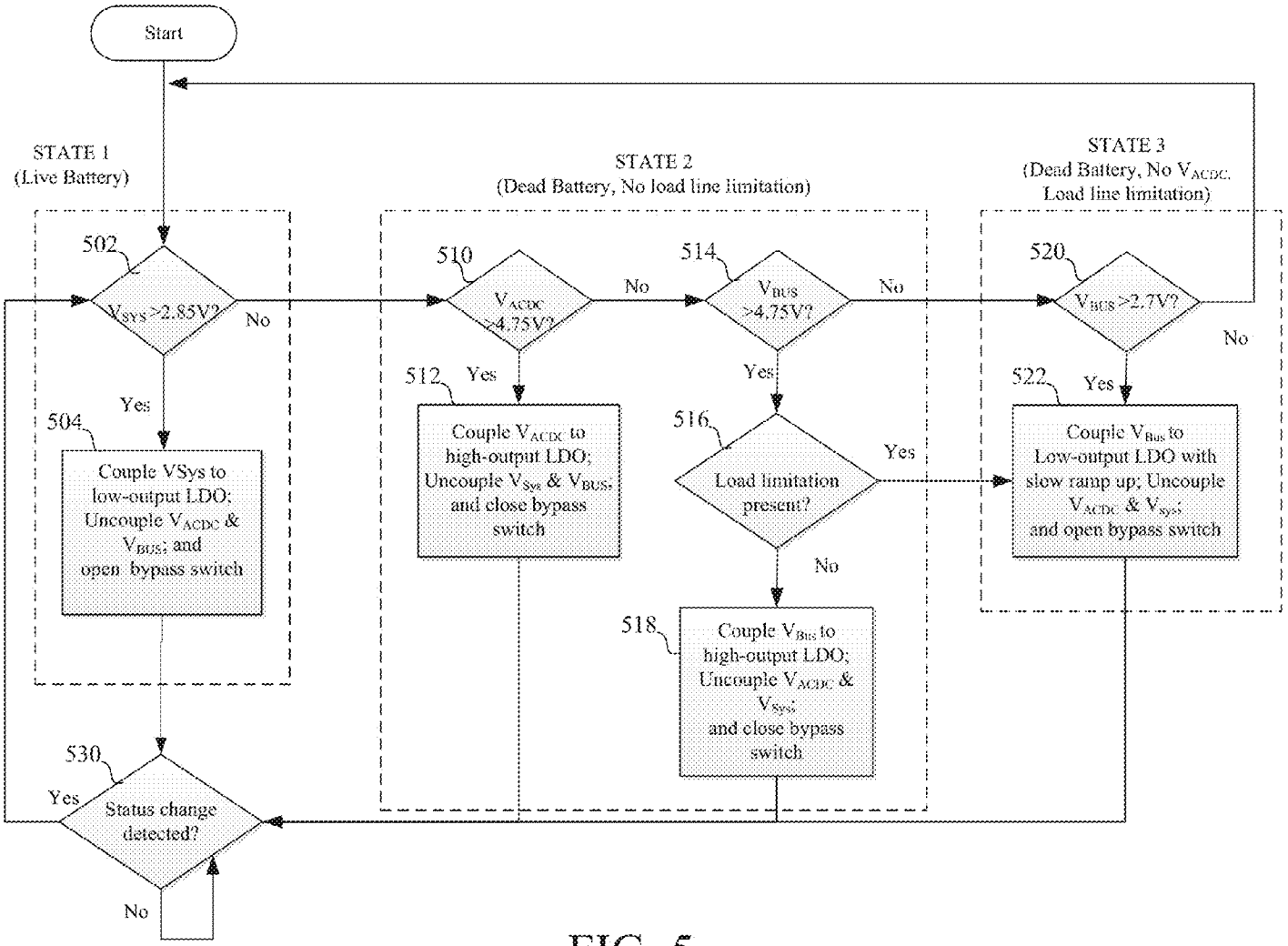
FIG. 5 shows a flowchart for dynamically transitioning between multiple power sources in a system, in accordance with one or more embodiments.

FIG. 5 shows an example flowchart for dynamically transitioning between multiple power sources in a system, in accordance with one or more embodiments. For ease of explanation, the process is described with reference to FIG. 3. The process starts at decision block 502. If $V_{SYS}$ is greater than 2.85V, $V_{SYS}$ is detected, and decision block 502 directs the process to block 504. At block 504, $V_{SYS}$ is coupled to the low-output LDO regulators 342, bypass switch 360 is opened, and $V_{ACDC}$ and $V_{BUS}$ are uncoupled from LDO regulators 340 and 342. If $V_{SYS}$ is less than 2.85V at decision block 502, the process is directed to decision block 510. If $V_{ACDC}$ is greater than 4.75V at decision block 510, the process is directed to block 512. At block 512, $V_{ACDC}$ is coupled to the high-output LDO regulator 340, bypass switch 360 is closed, and $V_{SYS}$ and $V_{BUS}$ are uncoupled from LDO regulators 340 and 342. If $V_{ACDC}$ is less than 4.75V, decision block 510 directs the process to decision block 514.

If $V_{BUS}$ is greater than 4.75V, decision block 514 directs the process to decision block 516. If $V_{BUS}$ is not load limited, decision block 516 directs the process to block 518. At block 518, $V_{BUS}$ is coupled to the high-output LDO regulator 340, bypass switch 360 is closed, and $V_{SYS}$ and $V_{ACDC}$ are uncoupled from LDO regulators 340 and 342. If $V_{BUS}$ is load limited, decision block 516 directs the process to block 522. At block 522, $V_{BUS}$ is coupled to the low-output LDO regulators 342, bypass switch 360 is opened, and $V_{SYS}$ and $V_{ACDC}$ are uncoupled from LDO regulators 340 and 342.

If $V_{BUS}$ is less than 4.75V at decision block 514, the process is directed to decision block 520. If $V_{BUS}$ greater than 2.7V at decision block 520, the process is directed to block 522. Otherwise, the process is directed back to decision block 502. The process may loop through decision blocks 502, 510, 514, and 520 until a suitable voltage supply is detected.

After coupling and uncoupling the voltage supplies at blocks 504, 512, 518, or 522, the process proceeds to decision block 530. The process stops at decision block 530 until a change in the status of the power-related conditions is detected. When such a change is detected, the process is restarted at block 530.

Various blocks, modules or other circuits may be implemented to carry out one or more of the operations and activities described herein and/or shown in the figures. In these contexts, a "block" (also sometimes "logic circuitry" or "module") is a circuit that carries out one or more of these or related operations/activities (e.g., monitoring power related conditions or selecting and coupling or voltage sources). For example, in certain of the above-discussed embodiments, one or more modules are discrete logic circuits or programmable logic circuits, configured and arranged for implementing these operations/activities, as in the circuit modules shown in FIGS. 1, 2, and 3. In certain embodiments, such a programmable circuit is one or more computer circuits programmed to execute a set (or sets) of instructions (and/or configuration data). The instructions (and/or configuration data) can be in the form of firmware or software stored in and accessible from a memory (circuit). As an example, first and second modules include a combination of a CPU hardware-based circuit and a set of instructions in the form of firmware, where the first module includes a first CPU hardware circuit with one set of instructions and the second module includes a second CPU hardware circuit with another set of instructions. Certain embodiments are directed to a computer program product (e.g., nonvolatile memory device), which includes a machine or computer-readable medium having stored thereon instructions which may be executed by a computer (or other electronic device) to perform these operations/activities.

Based upon the above discussion and illustrations, those skilled in the art will readily recognize that various modifications and changes may be made to the various embodiments without strictly following the exemplary embodiments and applications illustrated and described herein. For example, thought aspects and features may in some cases be described in individual figures, it will be appreciated that features from one figures can be combined with features of another figures even though the combination is not explicitly shown or explicitly described as a combination.

Such modifications do not depart from the true spirit and scope of various aspects of the invention, including aspects set forth in the claims.

What is claimed is:

1. An apparatus comprising:

a low drop-out (LDO) voltage-regulation circuit configured and arranged to generate a regulated voltage from a voltage provided to a supply terminal of the LDO voltage-regulation circuit; and switching circuitry coupled to the LDO voltage-regulation circuit and to a plurality of voltage sources including a power line carried along with a data bus and another voltage source, each of the plurality of voltage sources providing respectively different voltage ranges, the switching circuitry is configured and arranged, in response to a power-related condition of the plurality of voltage sources and while maintaining power to the LDO voltage-regulation circuit, to select and couple one of the power line and the other voltage source for providing energy to the supply terminal and un-couple the other of the power line and the other voltage source from the supply terminal.

2. The apparatus of claim 1, wherein the plurality of voltage sources includes at least three voltage sources; and the switching circuitry is further configured and arranged, in response to the one of the plurality of voltage sources coupled to the supply terminal becoming unavailable and while maintaining power to the LDO voltage-regulation circuit, to select another one of the plurality of voltage sources based on the power-related condition;

couple the selected one of the plurality of voltage sources to the supply terminal of the LDO voltage-regulation circuit; and uncouple other ones of the plurality of voltage sources from the supply terminal of the LDO voltage-regulation circuit.

3. The apparatus of claim 1, further comprising an energy storage circuit coupled to the supply terminal of the LDO voltage-regulation circuit.

4. The apparatus of claim 3, further comprising a second LDO voltage-regulation circuit having a second supply terminal connected to the energy storage circuit and configured and arranged to generate a second regulated voltage from a voltage provided to the second supply terminal.

5. The apparatus of claim 1, wherein the switching circuitry includes:

for each of a plurality of voltage sources, a respective switching circuit connected to the voltage source and configured and arranged to, couple the voltage source to the supply terminal of the LDO voltage-regulation circuit when enabled, and uncouple the voltage source from the supply terminal of the LDO voltage-regulation circuit when disabled; and a control circuit configured and arranged to, select one of the voltage sources based on a condition of the voltage sources; and while maintaining power to the LDO voltage-regulation circuit, select another one of the plurality of voltage sources based on the power-related condition;

couple the selected one of the plurality of voltage sources to the supply terminal of the LDO voltage-regulation circuit; and uncouple other ones of the plurality of voltage sources from the supply terminal of the LDO voltage-regulation circuit.

6. The apparatus of claim 5, wherein the regulated voltage generated by the LDO voltage-regulation circuit has a first voltage; and further comprising:

a high-output LDO voltage-regulation circuit configured and arranged to generate a second regulated voltage that is greater than the first voltage; and a bypass switch having a first end coupled to an output of the high-output LDO voltage-regulation circuit and a second end coupled to the supply terminal.

7. The apparatus of claim 6, wherein:

the plurality of voltage sources includes at least a high-voltage source and a low-voltage source; and the switching circuitry is configured to couple the low-voltage source directly to the supply terminal of the LDO voltage-regulation circuit; and couple the high-voltage source to the supply terminal of the LDO voltage-regulation circuit via the high-output LDO voltage-regulation circuit and the bypass switch.

8. The apparatus of claim 7, wherein: the control circuit is further configured to:

in response to selecting the high-voltage source, close the bypass switch; and in response to selecting the low-voltage source, open the bypass switch.

9. The apparatus of claim 1, wherein the plurality of voltage sources also includes the power line carried along with the data bus, a battery, and an ACDC power adapter.

10. The apparatus of claim 9, wherein the switching circuitry is further configured and arranged, in response to the battery having a voltage greater than a first threshold voltage, to couple the battery to the supply terminal of the LDO voltage-regulation circuit; and uncouple the power line and the ACDC power adapter from the supply terminal of the LDO voltage-regulation circuit.

11. The apparatus of claim 10, wherein the switching circuitry is further configured and arranged, in response to the battery having a voltage less than the first threshold voltage and the ACDC power adapter having a voltage greater than a second threshold voltage, to couple the ACDC power adapter to the supply terminal; and uncouple the battery and power line, carried along with the data bus, from the supply terminal.

12. The apparatus of claim 11, wherein the switching circuitry is further configured and arranged, in response to the battery having a voltage less than the first threshold voltage, the ACDC power adapter having a voltage less than the second threshold voltage, and the power line having a voltage greater than a third threshold voltage, to couple the power line to the supply terminal; and uncouple the battery and the ACDC power adapter from the supply terminal.

13. The apparatus of claim 12, wherein the switching circuitry is configured and arranged to perform the coupling of the power line to the supply terminal using:

a first switching circuit, in response to the power line being in a non-load-line-limited state; and a second switching circuit, in response to the power line being in a load-line-limited state.

14. The apparatus of claim 13, wherein the second switching circuit is configured and arranged to gradually increase current provided from the power line to the supply terminal until a threshold current is provided.

15. A method comprising:

using a switching circuit, in response to a power-related condition of a plurality of voltage sources and while maintaining power to a low-drop-out (LDO) voltage-regulation circuit, selecting and coupling one of a plurality of voltage sources, connected to the switching circuit, to a supply terminal of a voltage regulation circuit; and uncoupling other ones of the plurality of voltage sources from the supply terminal, the plurality of voltage sources including a power line carried along with a data bus and another voltage source; and generating a regulated voltage, using the LDO voltage-regulation circuit, from a voltage provided to a supply terminal of the LDO voltage-regulation circuit.

16. The method of claim 15, wherein:

the plurality of voltage sources includes at least three voltage sources; and in response to the one of the plurality of voltage sources coupled to the supply terminal becoming unavailable and while maintaining power to the LDO voltage-regulation circuit, selecting another one of the plurality of voltage sources based on the power-related condition;

coupling the selected one of the plurality of voltage sources to the supply terminal of the LDO voltage-regulation circuit; and uncoupling other ones of the plurality of voltage sources from the supply terminal of the LDO voltage-regulation circuit.

17. The method of claim 15, further comprising generating a second regulated voltage, using a second LDO voltage-regulation circuit, from a voltage source coupled to the supply terminal.

18. The method of claim 15, wherein the plurality of voltage sources includes at least a high-voltage source and a low-voltage source, and further comprising, in response to selecting the high-voltage source, generating a second regulated voltage from the high-voltage source, using a high-output LDO voltage regulator circuit, and coupling an output of the high-output LDO voltage regulator circuit to the supply terminal to provide the second regulated voltage to the supply terminal.

19. The method of claim 18, further comprising, in response to selecting the low-voltage source, uncoupling the output of the high-output LDO voltage regulator circuit to the supply terminal.

20. An apparatus comprising:

a voltage-regulation means for generating a regulated voltage from a voltage provided to a supply terminal of the voltage-regulation means; and switching means for, in response to a power-related condition of a plurality of voltage sources and while maintaining power to the voltage-regulation means, selecting and coupling one of a plurality of voltage sources connected to the switching means to the supply terminal and uncoupling other ones of the plurality of voltage sources from the supply terminal, the plurality of voltage sources including a power line carried along with a data bus and another voltage source.

21. The apparatus of claim 1, further comprising a capacitor coupled to the supply terminal of the LDO voltage regulation circuit.

22. The apparatus of claim 5, wherein the control circuit is configured and arranged to perform the coupling of the selected one of the plurality of voltage sources to the supply terminal of the LDO voltage-regulation circuit, and perform the uncoupling of the other ones of the plurality of voltage sources from the supply terminal of the LDO voltage-regulation circuit, without power cycling the LDO voltage-regulation circuit.

23. The apparatus of claim 5, wherein the control circuit is configured to prevent the coupling of the selected one of the plurality of voltage sources to the supply terminal of the LDO voltage-regulation circuit until the selected one of the plurality of voltage sources is stabilized.

* * * * *